US009687102B2

(12) United States Patent
Slyter

(10) Patent No.: US 9,687,102 B2
(45) Date of Patent: Jun. 27, 2017

(54) CURTAIN HANGER

(71) Applicant: THE BOEING COMPANY, Chicago, IL (US)

(72) Inventor: Kenneth Slyter, Kent, WA (US)

(73) Assignee: THE BOEING COMPANY, Chicago, IL (US)

( * ) Notice: Subject to any disclaimer, the term of this patent is extended or adjusted under 35 U.S.C. 154(b) by 2 days.

(21) Appl. No.: 14/607,421

(22) Filed: Jan. 28, 2015

(65) Prior Publication Data

US 2015/0282657 A1 Oct. 8, 2015

Related U.S. Application Data

(60) Provisional application No. 61/974,268, filed on Apr. 2, 2014.

(51) Int. Cl.
*A47H 1/00* (2006.01)
*A47H 13/04* (2006.01)

(52) U.S. Cl.
CPC ..... *A47H 13/04* (2013.01); *Y10T 24/51* (2015.01)

(58) Field of Classification Search
CPC ..... A47H 13/04; A47H 13/16; A47G 25/36; A47G 25/40; Y10T 24/51; Y10T 24/4602; Y10T 16/372; Y10T 16/375; Y10T 16/378; Y10T 16/3797; Y10T 24/3485; Y10T 16/353
USPC ..... 160/330, 348; 223/85
See application file for complete search history.

(56) References Cited

U.S. PATENT DOCUMENTS

| | | | | | |
|---|---|---|---|---|---|
| 442,926 | A * | 12/1890 | Traut | A47G 25/66 | 211/33 |
| 625,137 | A * | 5/1899 | Bowman | A47G 25/66 | 223/85 |
| 959,921 | A * | 5/1910 | Clerk | A47H 13/04 | 16/87.2 |
| 1,069,999 | A * | 8/1913 | Ashmore | A47H 13/04 | 24/360 |
| 1,281,562 | A * | 10/1918 | Hanson | A47G 25/28 | 223/85 |
| 3,252,636 | A * | 5/1966 | Roger | A47G 25/40 | 223/95 |
| 3,837,544 | A * | 9/1974 | Greenwald | B65D 33/14 | 223/87 |
| 5,096,100 | A * | 3/1992 | King | B65D 85/182 | 206/292 |
| 5,297,607 | A * | 3/1994 | Beauchamp | E06B 9/367 | 160/84.04 |
| 9,022,235 | B2 * | 5/2015 | Kalinsky | A47G 25/005 | 211/113 |

* cited by examiner

*Primary Examiner* — Katherine Mitchell
*Assistant Examiner* — Jeremy Ramsey
(74) *Attorney, Agent, or Firm* — Patterson + Sheridan, LLP

(57) ABSTRACT

A curtain hanger for hanging a curtain. The curtain hanger can be inserted into a pocket of a curtain. The curtain hanger can include a plurality of teeth or barbs that engage vertical stitches and/or pleats at edges of the pocket to hold the curtain hanger in the pocket. The teeth can be arranged at different widths and/or different angles such that the curtain hanger can be pinched to fit into pockets of different widths. The teeth can also be angled upwardly such that a tugging force on the curtain spreads the teeth apart and forces them into stronger engagement with the vertical stitches and/or pleats at the edges of the pocket.

16 Claims, 12 Drawing Sheets

CURTAIN HANGER

This application is a U.S. non-provisional patent application that claims the benefit of U.S. provisional patent application Ser. No. 61/974,268, filed Apr. 2, 2014. The aforementioned related patent application is incorporated herein by reference in its entirety.

BACKGROUND

Aspects disclosed herein relate to hangers for a curtain.

SUMMARY

According to one aspect disclosed herein, a curtain hanger can include a suspension member that engages a hanging mechanism on a bulkhead. For example, the suspension member can include a hook that engages a curtain rod on a ceiling or that engages a loop on a slider for a slider track. The curtain hanger can also include two wings extending in opposite directions from the suspension member. Each wing can include a support and a plurality of teeth arranged on the support. Each of the teeth can be configured to engage an interior of a pocket formed along a top portion of a curtain. For example, the teeth can engage vertical stitches and/or pleats along the edges of the pocket. The wings can be deformed toward the suspension member to insert the curtain hanger into the pocket. After being inserted, the wings can deform away from the suspension member so that the teeth can engage the vertical stitches and/or pleats. Additionally, if loads are applied to the curtain, forces transmitted to the teeth can further deform the wings outwardly away from the suspension member, to cause the teeth to further engage the vertical stitches and/or pleats.

According to one aspect disclosed herein, a curtain assembly can include a curtain that includes a plurality of pockets. The curtain assembly can also include a plurality of curtain hangers, wherein the plurality of curtain hangers are arranged in respective ones of the plurality of pockets. Each of the curtain hangers includes a suspension member configured to engage a hanging mechanism. Each of the curtain hangers also includes at least two wings extending in opposite directions from the suspension member. Each wing includes a support and a plurality of teeth arranged on the support. At least one of the plurality of teeth engage an interior of the respective ones of the plurality of pockets. The wings are positionable toward the suspension member for installation into and removal from the pocket of the curtain, and wherein the wings are positionable away from the suspension member to engage the interior of the respective one of the plurality of pockets.

According to one aspect disclosed herein, a method of installing a curtain hanger in a pocket of a curtain is disclosed, wherein the curtain hanger comprises a suspension member configured to engage a hanging mechanism on a bulkhead and at least two wings extending in opposite directions from the suspension member, wherein each of the two wings include a support and a plurality of teeth arranged on the support, wherein the wings are positionable toward the suspension member for insertion into the pocket of the curtain, and wherein the wings are positionable away from the suspension member after insertion into the curtain to engage the interior of the pocket. The method includes positioning the wings toward the suspension member. The method also includes inserting the curtain hanger into an opening of the pocket. The method also includes positioning the wings away from the suspension member such that the teeth of the wings engage at least one of stitching and pleats arranged at sides of the pocket.

BRIEF DESCRIPTION OF ILLUSTRATIONS

DETAILED DESCRIPTION

Curtains are used in a variety of applications. For example, a curtain can cover a window or partition a space into separate sections. For example, in a hospital, curtains may be used to provide privacy to different beds in a hospital ward. As another example, curtains can be used to separate a first-class cabin of an aircraft from a coach class cabin of an aircraft. In various aspects described herein, hangers can be attached within pockets on the top of the curtain so that the curtain can be hung from the ceiling, wall, bulkhead, and/or other support structure.

Figure 1A:
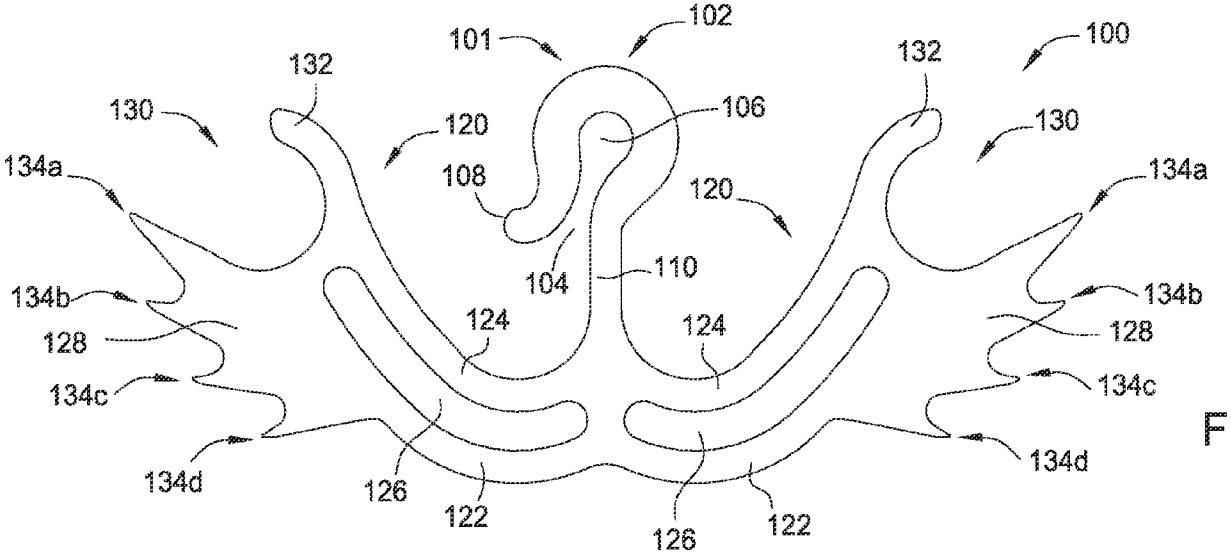
FIG. 1A is a side view of an aspect of a hanger in an undeformed state.
Figure 1B:
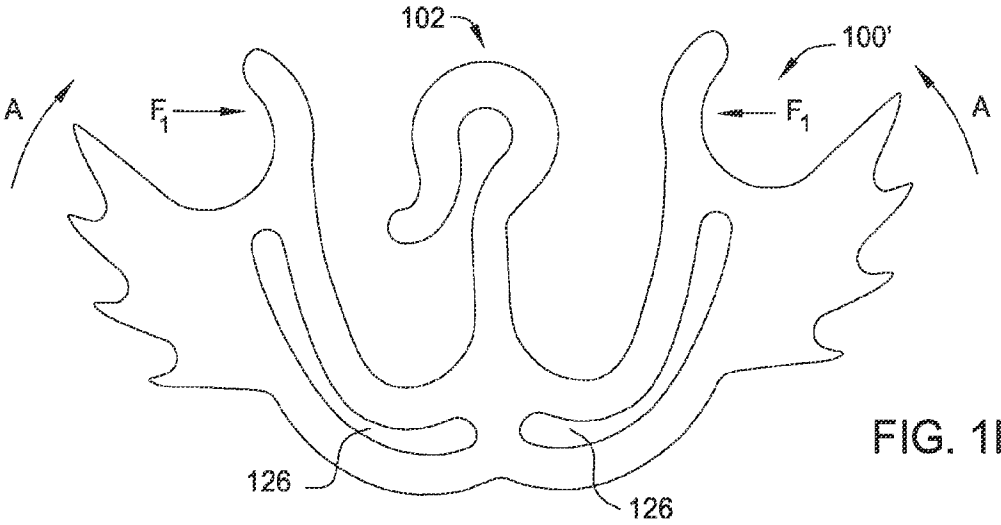
FIG. 1B is a side view of the hanger of FIG. 1A in a deformed state.

With reference now to FIGS. 1A and 1B, aspects of a curtain hanger 100 include a suspension member 101. The suspension member 101 includes a hook 102 attached to a neck 110. The hook 102 can include an opening 104 in communication with an aperture 106. The aperture 106 can engage a curtain rod or other attachments (discussed below). The curtain hanger 100 can include two wings 120 extending in substantially opposite directions from the neck 110 of the suspension member 101. Each wing 120 can include a first member 122 and a second member 124 extending from the neck 110. The first member 122 and the second member 124 can transition into a body or support 128. The first member 122 and the second member 124, the body 128, and the neck 110 can define an aperture 126. The support 128 of each wing 120 can include a plurality of gripping teeth or barbs (e.g., teeth 134*a-d*). The body 128 can also include a grip portion 130 and a tab 132. The curtain hanger 100 illustrated in FIG. 1A is in an undeformed state.

Referring now to FIG. 1B, the curtain hanger 100' can be gripped in the grip portions 130 (e.g., by a person's fingers, by a pair of pliers, by an installation tool, etc.) and squeezed, resulting in a force $F_1$ being applied to the grip portions 130 and/or to the tabs 132. When sufficient force $F_1$ is applied to the grip portions 130 and/or to the tabs 132, the first member 122 and the second member 124 can resiliently deform such that the wings 120 can move in the direction of arrows A toward the hook 102.

In various aspects, the curtain hanger 100 is made of a somewhat elastic material, such as a nylon polymer or another plastic that returns to an original shape after being deformed (i.e., is resiliently deformable). In various aspects, the curtain hanger 100 can be made of metal, such as spring steel.

Figure 2A:
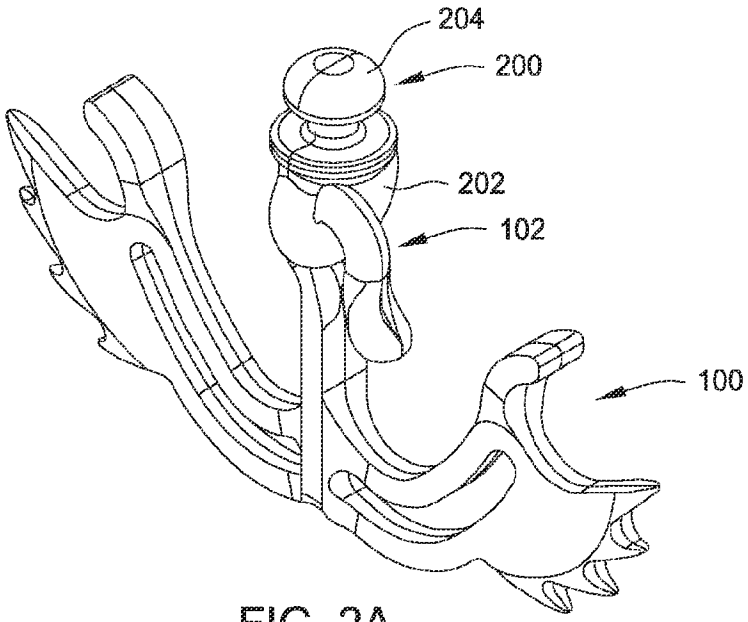
FIG. 2A is a perspective view of the hanger of FIG. 1A attached to a slider.
Figure 2B:
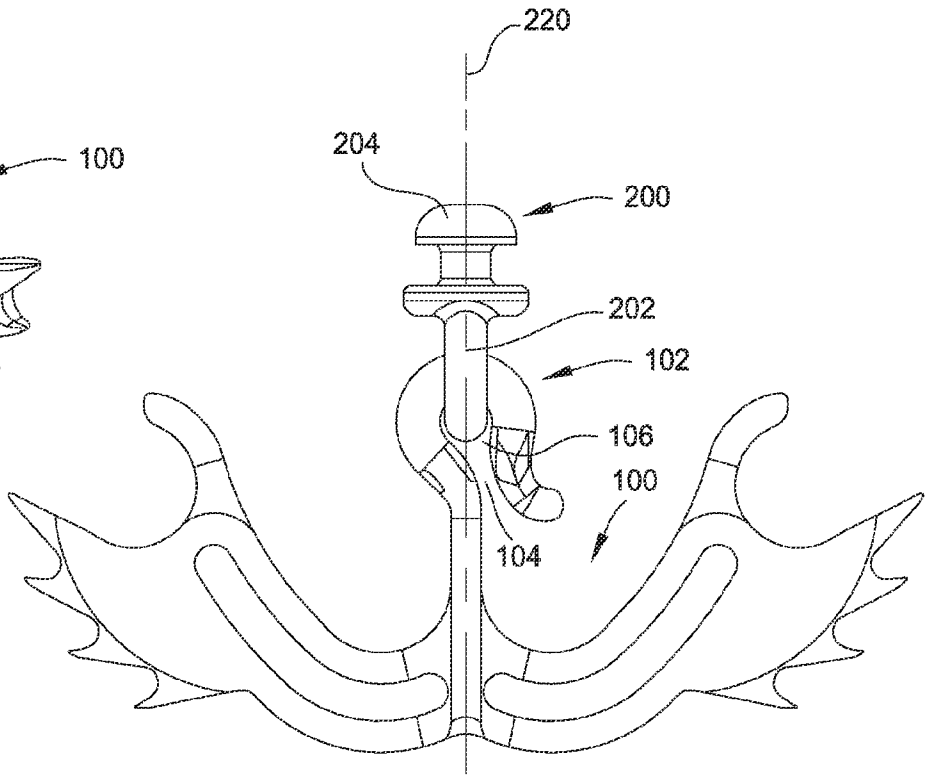
FIG. 2B is a side view of the hanger of FIG. 1A attached to the slider shown in FIG. 2A.

FIGS. 2A and 2B illustrate the curtain hanger 100 attached to a slider 200. A plurality of sliders 200 can engage a slider track (e.g., mounted to a ceiling of a room or to a bulkhead in an aircraft cabin). The plurality of sliders 200 can slide along the slider track to expand or retract a curtain attached to curtain hangers 100. Each slider 200 can include a loop 202 and a slider track engagement member 204. The slider track engagement member 204 can engage the slider track such that the slider 200 can move along the track but cannot be pulled out of the track under ordinary forces that might be applied to the curtain, curtain hanger 100, and/or slider 200. In various aspects, the slider 200 can rotate about an axis 220 to enable the curtain hanger 100 to rotate to follow movement of a curtain suspended from the curtain hanger 100. In various aspects, the entire slider 200 can rotate about the axis such that the slider track engagement member 204 rotates relative to the track. In various other aspects, the slider track engagement member 204 may not rotate relative to the track, but the loop 202 can rotate relative to the slider track engagement member 204. As shown in FIGS. 2A and 2B, the aperture 106 of the hook 102 of the curtain hanger 100 can engage the loop 202 of the slider 200 by passing the loop 202 through the opening 104 in the hook 102.

Figure 3B:
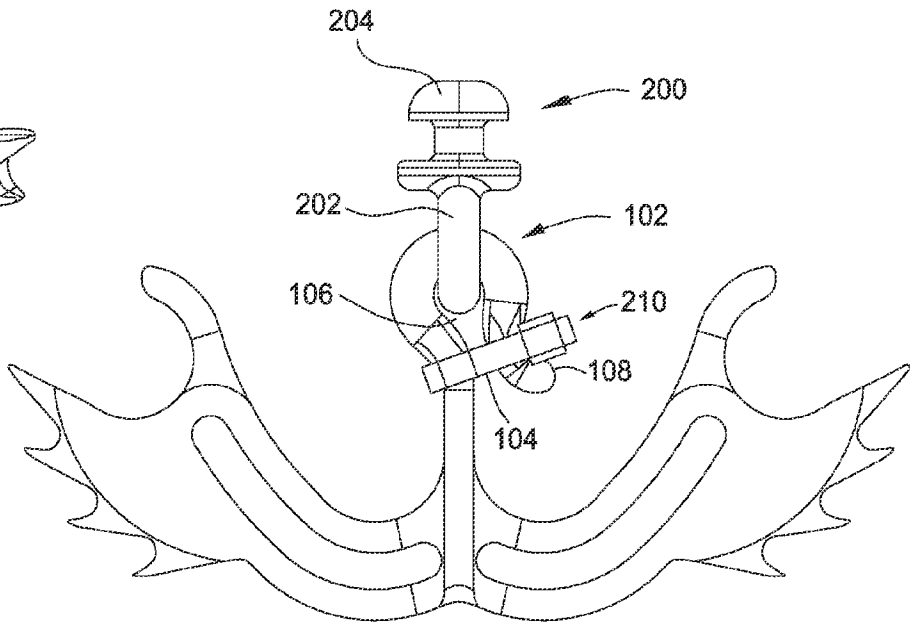
FIG. 3B is a side view of the hanger of FIG. 1A, attached to the slider of FIG. 2A and secured to the slider with a plastic tie.
Figure 3A:
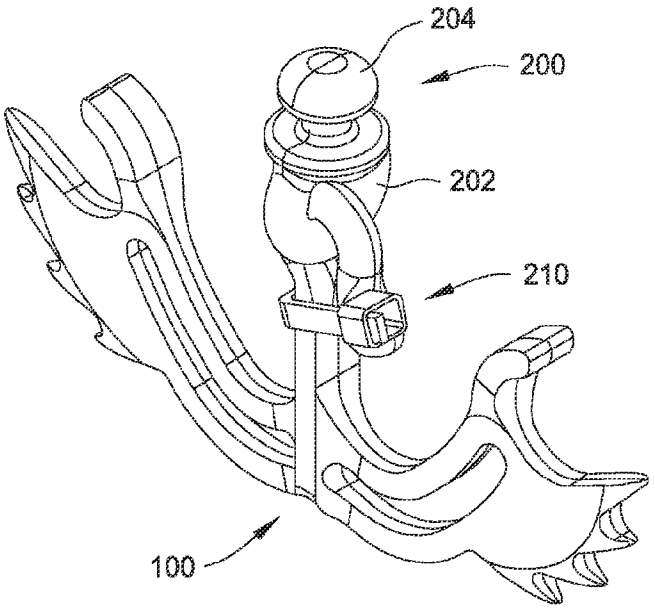
FIG. 3A is a perspective view of the hanger of FIG. 1A attached to the slider of FIG. 2A and secured to the slider with a plastic tie.

Referring now to FIGS. 3A and 3B, in various aspects, a plastic strap or zip tie 210 can be wrapped around the hook 102 after the hook has engaged the loop 202 of the slider 200. The hook 102 can include a flared out portion 108 that can prevent the secured zip tie 210 from slipping off the hook 102. The zip tie 210 can help prevent the hook 102 from being pulled open (e.g., if someone pulls down on a curtain being suspended by the curtain hanger 100) such that the curtain hanger can be pulled off of the slider 200.

Figure 8B:
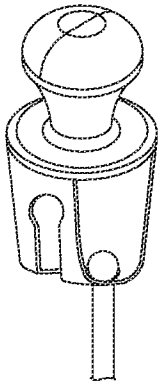
FIG. 8B is a perspective view of the neck having a spherically-shaped cap of FIG. 8A engaged in the aperture of the slider.
Figure 8A:
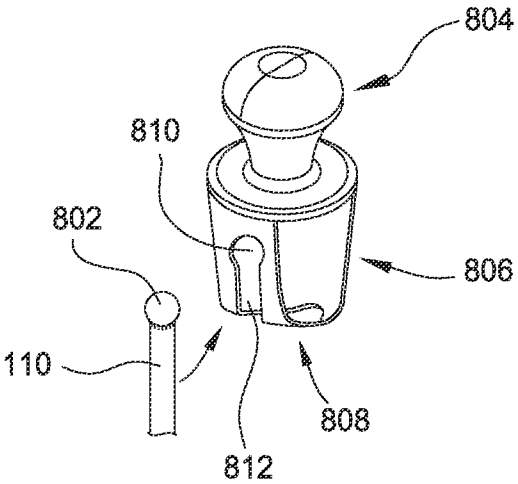
FIG. 8A is a perspective view of an aspect of a slider for a slider track and a neck of a curtain hanger having a spherically-shaped cap arranged for engagement with an aperture of the slider.

In various other aspects, the hook 102 of the curtain hanger 100 can be attached to various other types of hanging assemblies. For example, each hook 102 can engage a curtain rod. In various other aspects, the curtain hanger may engage a slider feature using a shape different from a hook. For example, referring to FIGS. 8A and 8B, in various aspects, the suspension member includes a neck 110 that terminates in a spherically-shaped cap 802. A slider 804 can include a bent sheet of material 806 (e.g., steel, aluminum, etc.) that includes an aperture 808 with two portions. A first portion 810 of the aperture 808 includes a dimension large enough for the spherically-shaped cap 802 on the end of the neck 110 to pass through. A second portion 812 of the aperture 808 includes a dimension too small for the spherically-shaped cap 802 on the end of the neck 110 to pass through. Generally, the first portion 810 of the aperture 808 can be positioned higher than the second portion 812 of the aperture 808. In use, the spherically-shaped cap 802 on the end of the neck 110 of the curtain hanger 100 can be passed through the first portion 810 of the aperture 808 and thereafter be moved to the second portion 812 of the aperture 808 (as shown in FIG. 8B) such that the smaller dimension of the second portion retains the spherically-shaped cap 802 of the neck 110.

Figure 4A:
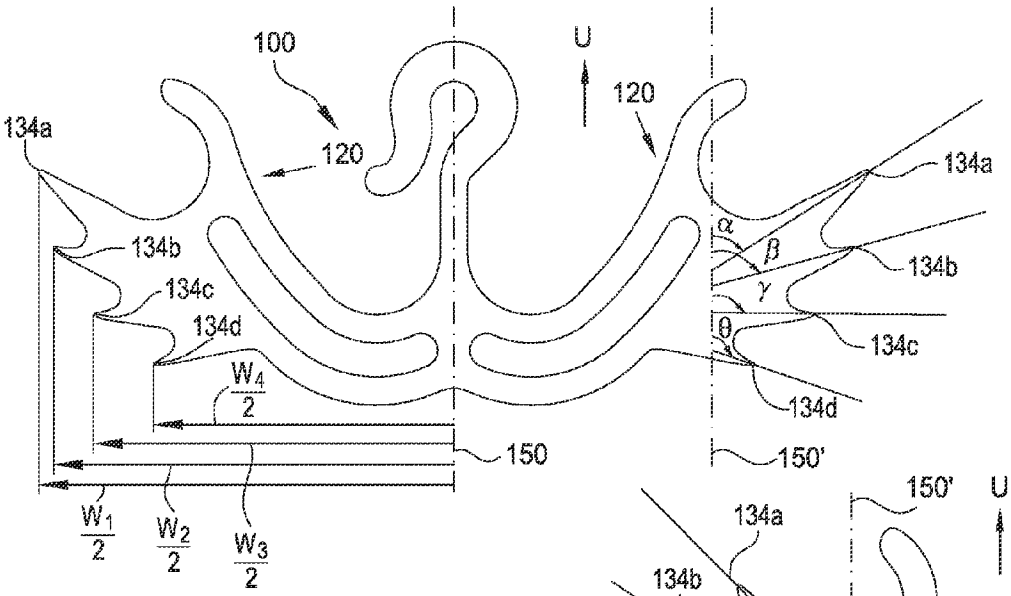
FIG. 4A is a side view of the hanger of FIG. 1A in the undeformed state, illustrating angles between gripping teeth of the hanger relative to an upward direction of a longitudinal axis.
Figure 4B:
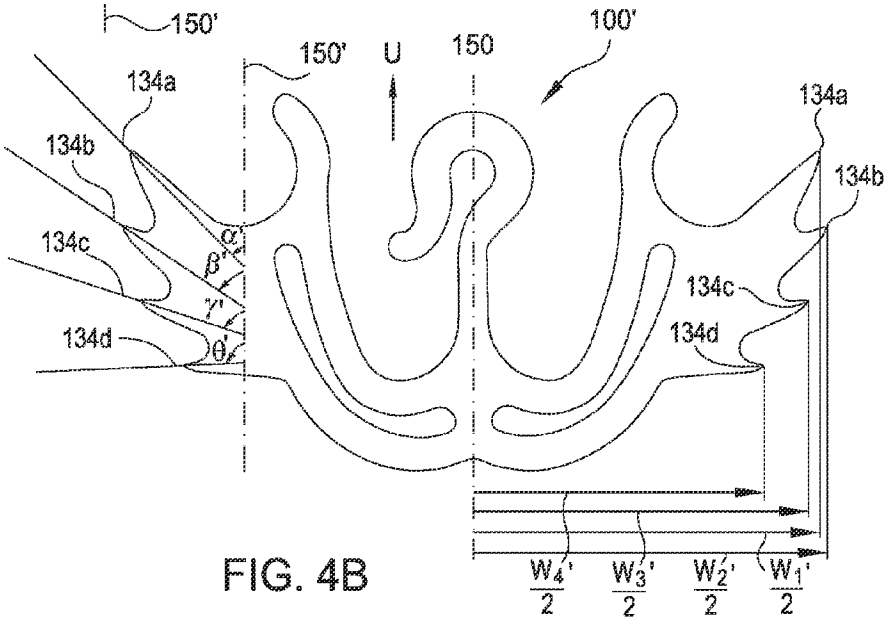
FIG. 4B is a side view of the hanger of FIG. 1B in the deformed state, illustrating changed angles between gripping teeth of the hanger relative to the upward direction of the longitudinal axis.

Referring now to FIGS. 4A and 4B, the gripping teeth 134*a-d* of the curtain hanger 100 can define respective angles relative to an upward direction (indicated by arrow U) of a longitudinal axis 150, such that at least one of the gripping teeth 134*a-d* includes an upward—facing component. In both the undeformed state shown in FIG. 4A and the deformed state shown in FIG. 4B, the curtain hanger 100 and 100' can define a longitudinal axis 150 (e.g. along the neck 110). For the purpose of illustrating angles of the teeth 134*a-d*, FIGS. 4A and 4B also show a displaced longitudinal axis 150'. In the aspect of the curtain hanger shown in FIGS. 4A and 4B, each wing 120 of the curtain hanger 100 includes four gripping teeth 134*a*, 134*b*, 134*c*, and 134*d*. Each gripping tooth can define an angle relative to an upward direction (indicated by arrow U) of the longitudinal axis 150 (i.e., 150'). For example, a first gripping tooth 134*a* can define an angle $\alpha$ relative to the upward direction of the longitudinal axis 150. As another example, a second gripping tooth 134*b* can define an angle $\beta$ relative to the upward direction of the longitudinal axis 150. As another example, a third gripping tooth 134*c* can define an angle $\gamma$ relative to the upward direction of the longitudinal axis 150. As another example, a fourth gripping tooth 134*d* can define an angle $\theta$ relative to the upward direction of the longitudinal axis 150.

In various aspects, in the undeformed state, at least one of the gripping teeth 134*a-d* can be arranged so that the angle relative to the upward direction of the longitudinal axis 150 is acute (i.e., less than ninety degrees). For example, referring to FIG. 4A, at least angles $\alpha$ and $\beta$ are acute relative to the upward direction of the longitudinal axis 150. In the deformed state, shown in FIG. 4B, angles $\alpha$, $\beta$, $\gamma$, and $\theta$ of the gripping teeth 134*a-d*, respectively, can become more acute and/or can become acute. For example, the angle $\alpha$ defined by the first gripping tooth 134*a* is more acute in the deformed state of the curtain hanger 100' (shown in FIG. 4B) than in the undeformed state of the curtain hanger 100 (shown in FIG. 4A). As another example, the angle $\beta$ of the second gripping tooth 134*b* is also more acute in the deformed state of the curtain hanger 100' than in the undeformed state of the curtain hanger 100. As another example, the angle $\gamma$ of the third gripping tooth 134*c* is approximately perpendicular to the longitudinal axis in the undeformed state of the curtain hanger 100 but is acute relative to the upward direction of the longitudinal axis. As a final example, the angle $\theta$ of the fourth gripping tooth 134*d* is an obtuse angle (i.e., more than ninety degrees) relative to the upward direction of the longitudinal axis 150 in both FIGS. 4A and 4B. However, the angle $\theta$ is less obtuse (i.e., closer to being a perpendicular angle or an acute angle) in the deformed state of the curtain hanger 100' shown in FIG. 4B than in the undeformed state of the curtain hanger 100 shown in FIG. 4A. Further deformation of the curtain hanger 100 may cause the angle θ of the fourth gripping tooth 134*d* to become acute relative to the upward direction of the longitudinal axis 150.

Figure 5:
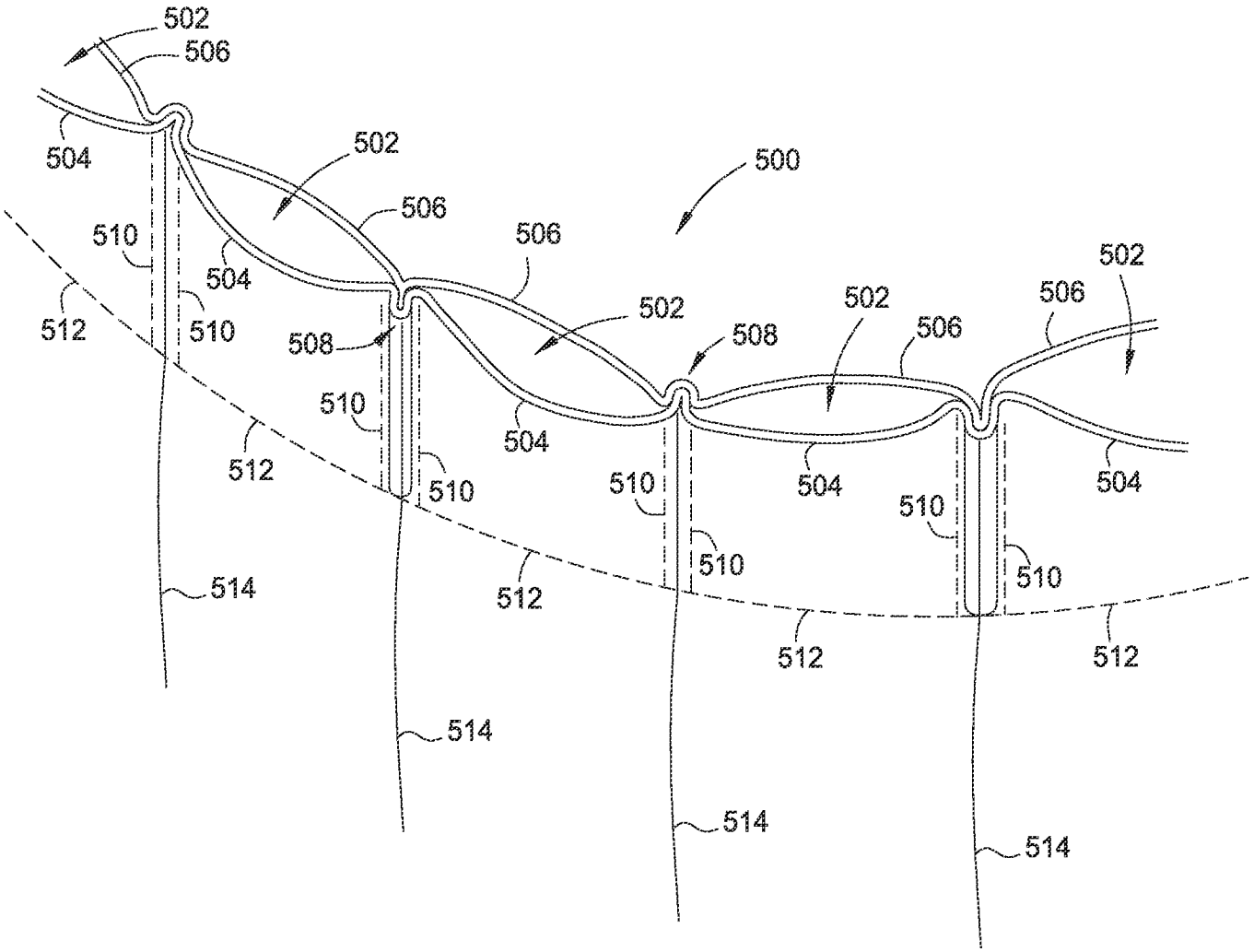
FIG. 5 is a perspective view of a top of a curtain that includes pockets for receiving a hanger, such as the hanger shown in FIG. 1A.

FIG. 5 is a perspective view of a top portion of an aspect of a curtain for use with aspects of the curtain hanger 100. The curtain includes a first panel of fabric 504 and a second panel of fabric 506. The panels of fabric 504 and 506 can be stitched with thread to form pockets 502. For example, a horizontal stitch 512 can define bottoms of the pockets. Also, vertical stitches 510 can define sides of the pockets 502 and pleats 508 between the pockets 502. The pleats 508 can be formed, generally, by folding a portion of the panels 504 and 506 and sewing the stitches 510 through the folded panels 504 and 506. The pockets 502 are generally open on top. For illustration purposes, the pockets 502 are shown with the panels 504 and 506 spaced apart. In various aspects, when two adjacent pleats 508 are pulled apart, the pocket 502 there between can become flat such that panels 504 and 506 lie against one another.

Figure 6A:
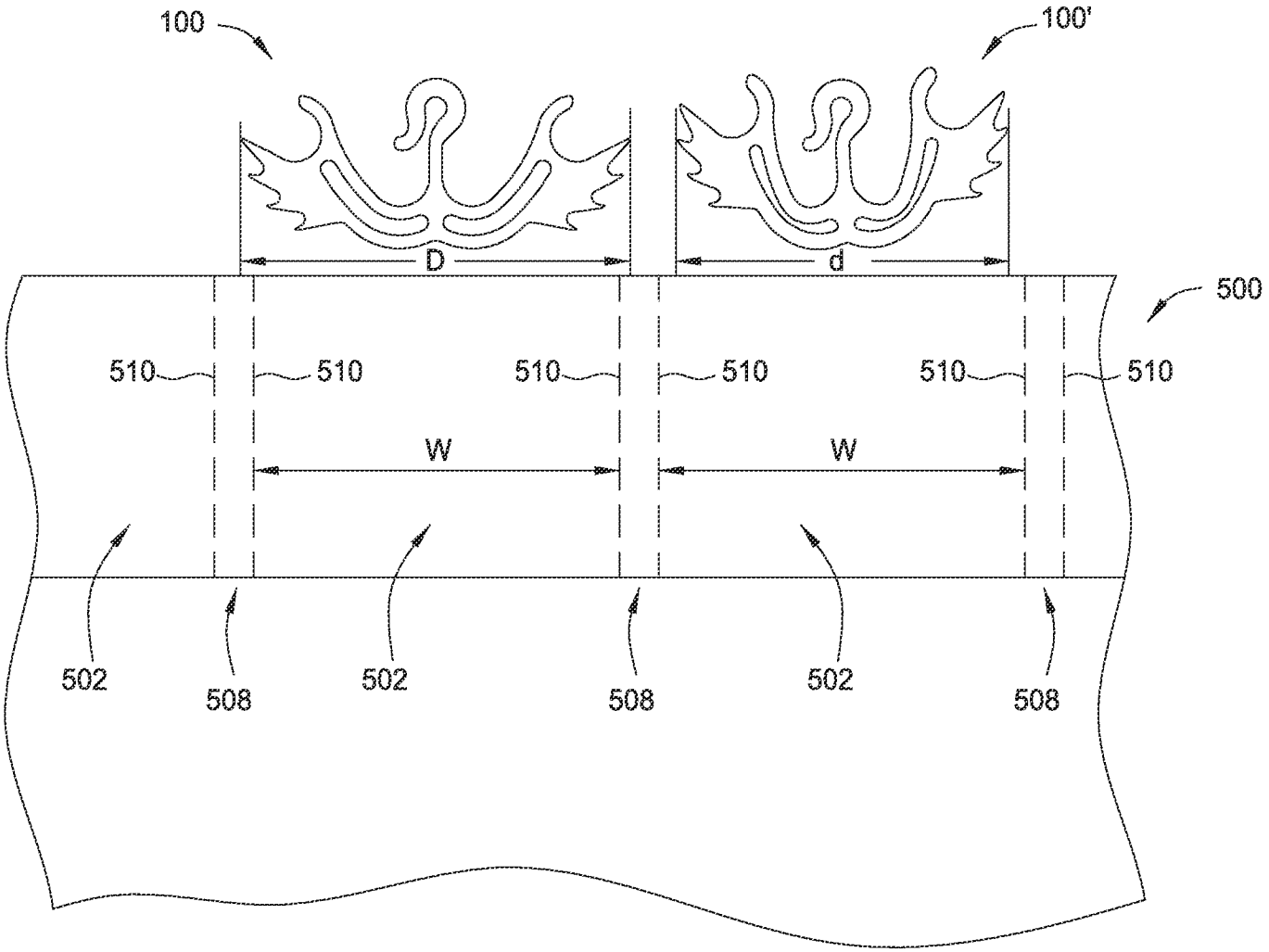
FIG. 6A illustrates a side view of the curtain of FIG. 5 with a hanger in an undeformed state and a hanger in a deformed state shown above respective pockets of the curtain.
Figure 6B:
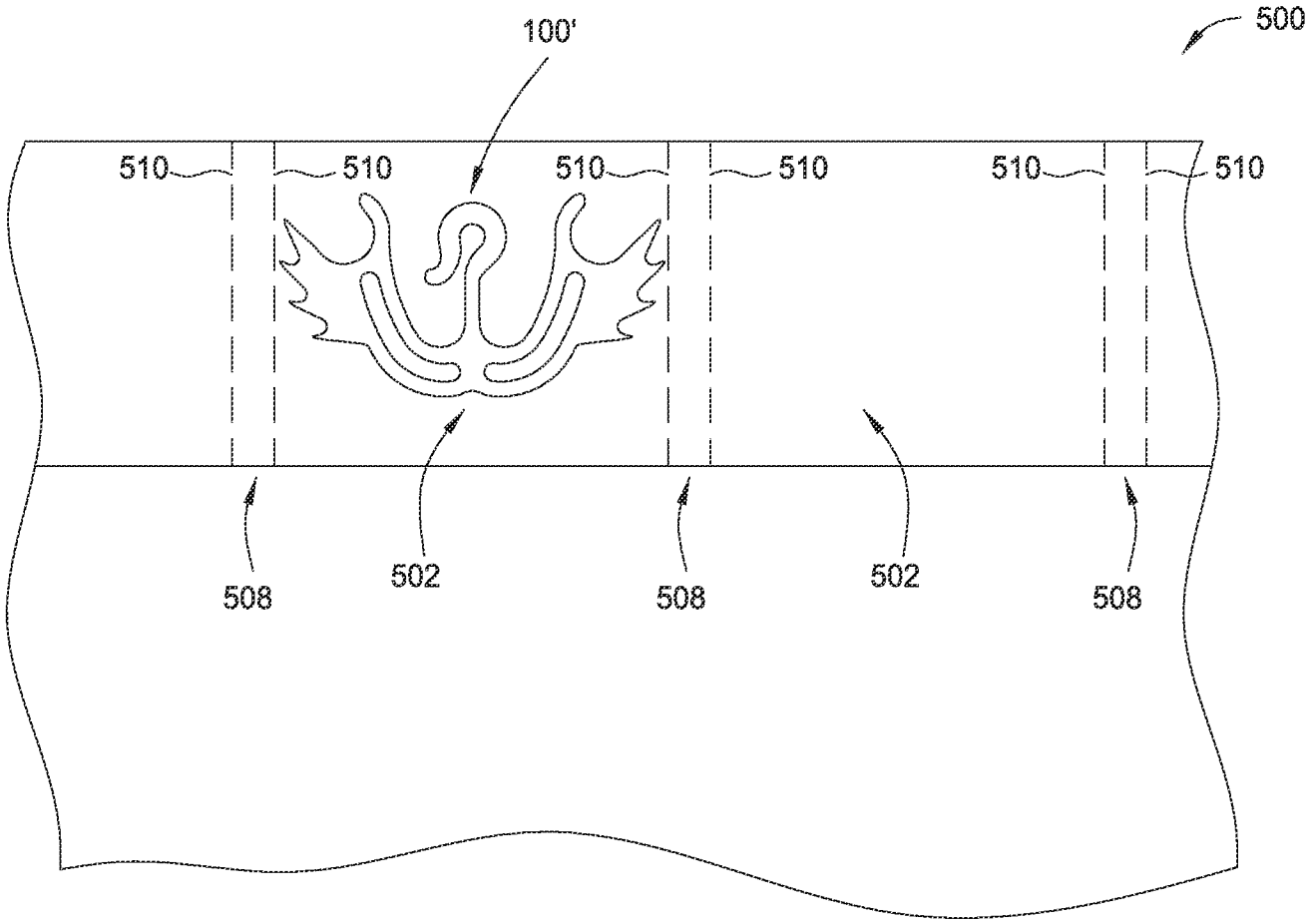
FIG. 6B shows a hanger in a deformed state inserted into a pocket of the curtain of FIG. 5.
Figure 9A:
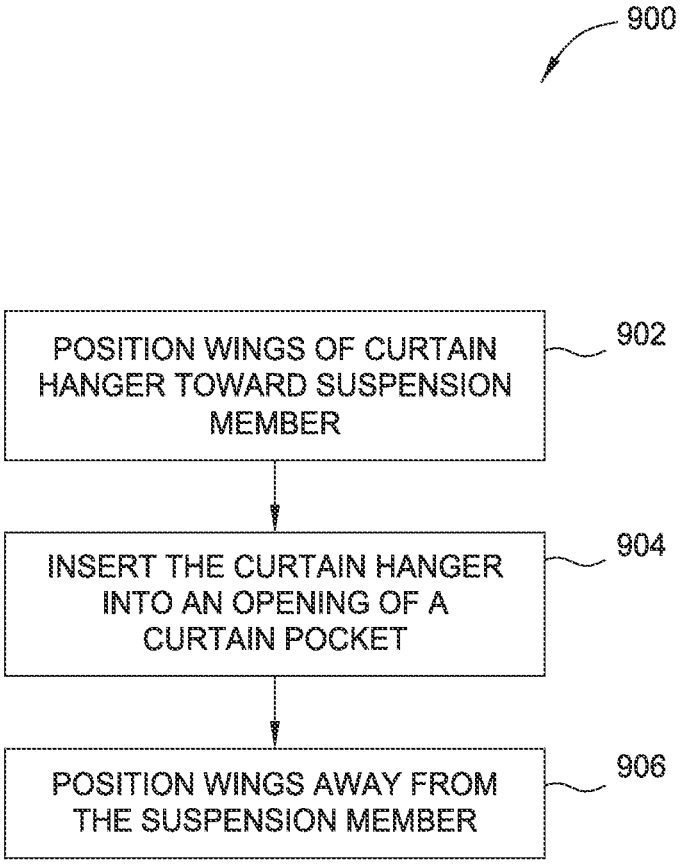
FIG. 9A is a flow chart for a method for installing the curtain hanger of FIG. 1A in a pocket of a curtain.

Referring now to FIGS. 6A and 9A, a curtain hanger 100 can be inserted into each pocket 502 of the curtain 500. FIG. 6A illustrates an undeformed curtain hanger 100 and a deformed curtain hanger 100'. As shown, the undeformed curtain hanger 100 may include a dimension D that is slightly larger than a width W of the pocket 502. The deformed curtain hanger 100' may include a dimension d that is slightly smaller than the width W of the pocket 502. In various instances, the curtain hanger 100' can be deformed to a degree necessary to fit within pockets of different widths (block 902 of the method 900 shown in FIG. 9A). Referring now to FIG. 6B, the deformed curtain hanger 100', with its smaller dimension d, can be inserted into the pocket 502 between the panels 504 and 506 (shown in FIG. 5) of fabric (block 904 of FIG. 9A). For example, an installer can squeeze the grip portions 130 and/or tabs 132 (shown in FIG. 1A) of the curtain hanger 100 to deform it. While squeezing the grip potions 130 and/or tabs 132, the installer can insert the deformed curtain hanger 100' into the pocket 502 (see FIGS. 5, 6A, and 6B).

Figure 6C:
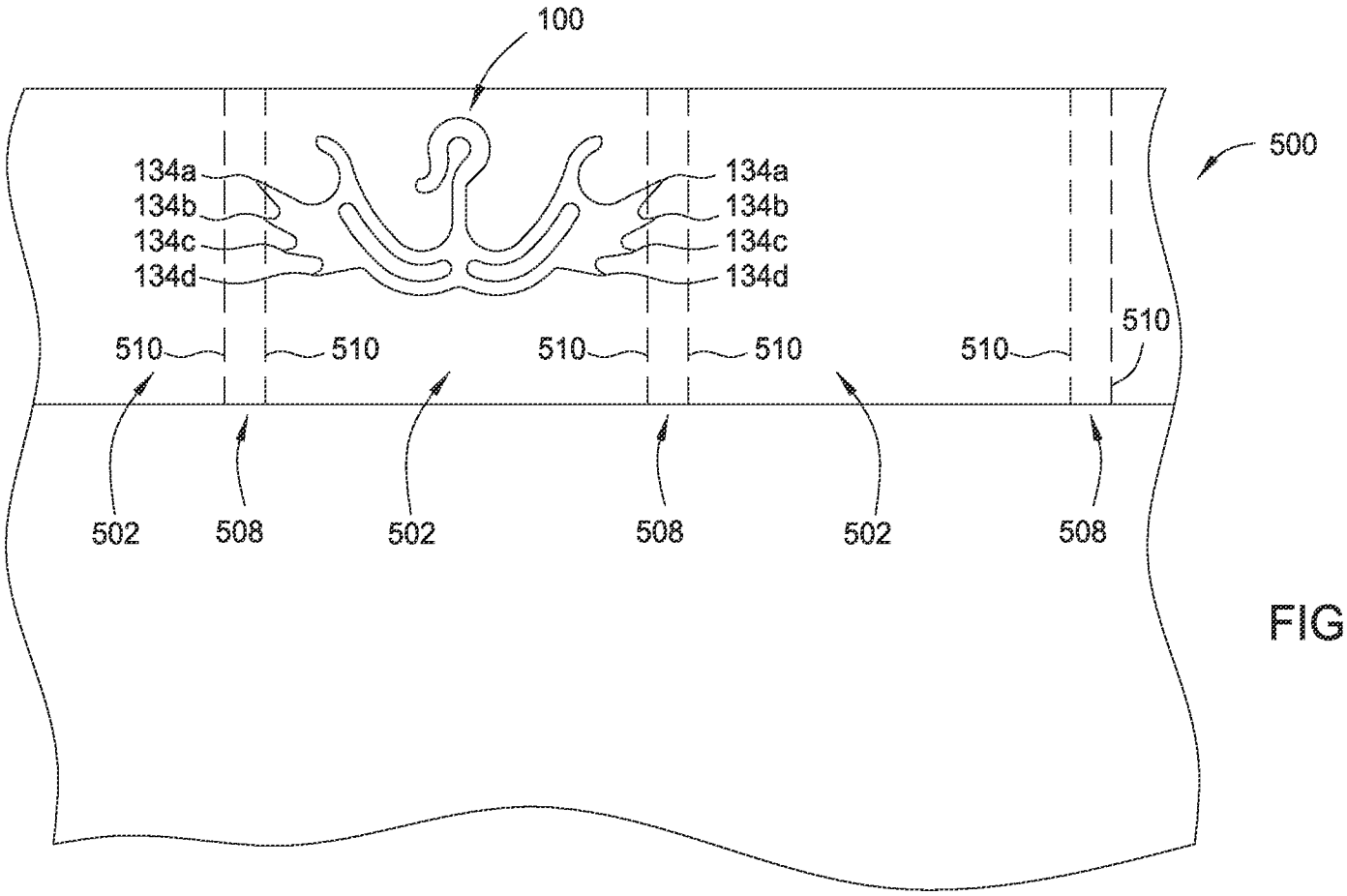
FIG. 6C illustrates the hanger in the pocket of the curtain in an undeformed or relaxed state.

Referring now to FIG. 6C, after the deformed curtain hanger 100' is inserted into the pocket 502, the grip portions 130 and/or tabs 132 can be released to allow the deformed curtain hanger 100' to relax and expand toward the undeformed state 100 (block 906). As the deformed curtain hanger 100' expands, some of the gripping teeth 134*a-d* can engage the vertical stitching 510 and the portions of fabric panels 504 and 506 that make up the pleats 508. The engagement of (at least some of) the gripping teeth 134*a-d* with the vertical stitching 510 and/or the material of the pleats 508 can hold the curtain hanger 100 in place.

Referring again to FIG. 4A, the gripping teeth 134*a-d* can each be arranged at a different distance from the longitudinal axis such that each pair of teeth defines a different width for the curtain hanger 100. For example, the first gripping teeth 134*a* of the wings 120 can define a first width $W_1$. As another example, the second gripping teeth 134*b* of the wings 120 can define a second width $W_2$ that is less than the first width $W_1$. As another example, the third gripping teeth 134*c* of the wings 120 can define a third width $W_3$ that is less than either the first width $W_1$ or the second width $W_2$. As another example, the fourth gripping teeth 134*d* of the wings 120 can define a fourth width $W_4$ that is less than any of the first width $W_1$, the second width $W_2$, and the third width $W_3$.

Referring again to FIG. 4B, deformation of the curtain can cause the widths to be reduced by varying degrees. For example, in the deformed state of the curtain hanger 100' shown in FIG. 4B, the width defined by the first gripping teeth 134*a* of the wings 120 can be reduced to $W_1'$. However, the width defined by the second gripping teeth 134*b* of the wings 120 can be reduced to a lesser degree to a width $W_2'$ such that $W_2'$ is greater than $W_1'$.

If a deformed curtain hanger 100' is installed into different pockets of different widths, the tooth or teeth 134*a-d* that engages the vertical threads and/or pleats of the pocket may depend on the width of the pocket. For example, if the pocket is of a width that is close to the width of the curtain hanger 100 in its undeformed state, then the first gripping tooth 134*a* is most likely to engage the vertical threads and/or pleats, although additional teeth (e.g., teeth 134*b*, 134*c*, and 134*d*) may also engage the threads and/or pleats. As another example, if a pocket is significantly narrower than the width of the curtain hanger 100 in its undeformed state, then the deformed curtain hanger 100' may not return to its fully undeformed state after it is inserted into the pocket and released. As a result, the first tooth 134*a* may not engage the vertical stitches and/or pleats of the pocket. Instead, referring again to FIG. 4B, the second tooth 134*b* may engage the vertical stitches and/or pleats. By placing the teeth 134*a-d* at different widths, a single curtain hanger 100 design can be deformed to different degrees to engage pockets of different widths.

As described above, the teeth 134*a-d* of the curtain hanger include at least one tooth that is arranged at an acute angle relative to an upward direction of a longitudinal axis 150 of the curtain hanger 100. As a result, the teeth with such an acute angle include an upward-facing component.

Figure 7:
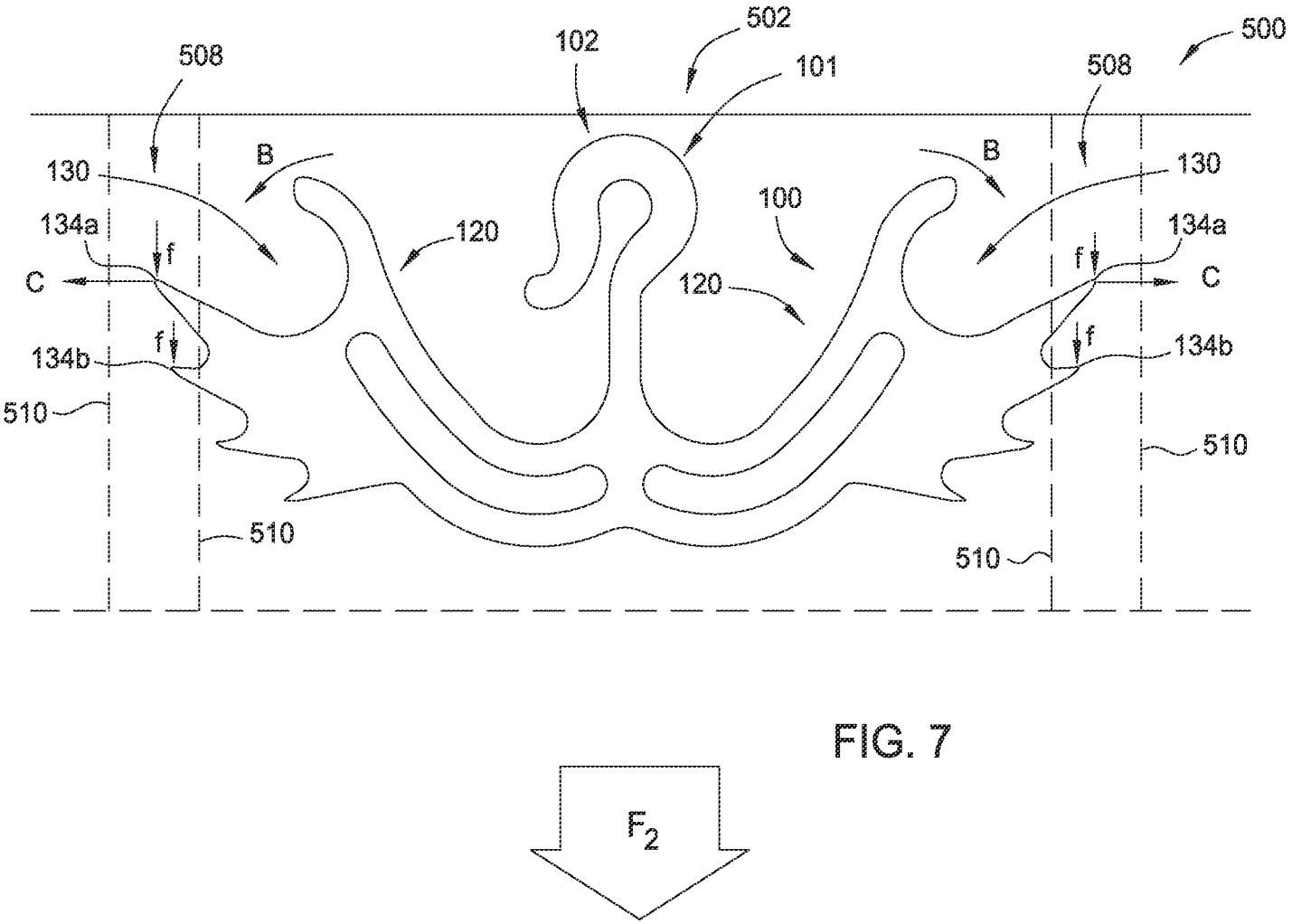
FIG. 7 illustrates forces on a curtain and a hanger.

FIG. 7 illustrates a single curtain hanger 100 installed in a curtain 500. The curtain 500 can include a plurality of such curtain hangers 100 suspending the curtain 500 from a curtain rod, sliders 200, or the like. As shown in FIG. 7, teeth 134*a* and 134*b* may be engaged with the vertical stitching 510 and/or the pleats 508 and include an upward-facing component. This upward-facing component of the teeth 134*a* and 134*b* may enable the curtain hanger 100 to more-strongly engage the vertical stitches 510 and/or pleats 508 on the sides of the pocket 502 when a force $F_2$ is applied to the curtain 500. For example, someone may grab onto (and pull downwardly on) the curtain 500 for stability. The force $F_2$ is ultimately transmitted to the curtain rod or the sliders 200 through the curtain hangers 100. The force $F_2$ can be transmitted from the curtain 500 to the teeth 134*a* and 134*b* that are engaged with the vertical stitches 510 and/or the pleats 508 of the curtain. Each tooth 134*a* and 134*b* may receive a fraction f of the force $F_2$ applied to the curtain. The forces f may pull the wings 120 of the curtain hanger 100 downwardly in the direction of arrows B. As a result, the teeth 134*a* and 134*b* shift outwardly in the direction of arrows C. This outward shift can cause the teeth 134*a* and 134*b* to engage (e.g., dig into) further into the vertical stitches 510 and/or the pleats 508. Additionally, the unengaged teeth 134*c* and 134*d* may begin to engage the vertical stitches 510 and/or the pleats 508. As a result, the teeth 134*a-d* may be more strongly engaged with the vertical stitches 510 and/or the pleats 508 of the curtain 500, making it less likely that the curtain hangers 100 will break free from the pockets 502 when the force $F_2$ is applied to the curtain 500.

As described above, in various aspects, the wings 120 of the curtain hanger 100 can include a first member 122 and a second member 124. Having a plurality of members can inhibit twisting of the body 128 of each wing 120 when forces f are applied to the teeth 134*a-d*. Referring again to FIG. 7, if the second member 124 is removed, when the force f is applied to the teeth 134*a-d*, the body 128 may twist about the first member 122 and allow the teeth 134*a-d* to slip out of engagement with the vertical stitches 510 and/or the pleats 508. Having a first member 122 and a second member 124 can reduce such twisting and keep the teeth 134*a-d* engaged with the vertical stitches 510 and/or pleats 508 when the force $F_2$ is applied.

In the event that too much force $F_2$ is applied to the curtain 500, the curtain 500 may fail by vertical stitching 510 tearing. Such a failure may be readily repaired by repairing and/or replacing the broken vertical stitching 510.

In various aspects, the curtain hanger may not be deformable. For example the wings of a curtain hanger may be attached to a neck of the curtain hanger by hinges so that the wings pivot about the hinges to move towards the neck (e.g., arrow A shown in FIG. 1B) or away from the neck (e.g., arrow B shown in FIG. 7). The hinges can include springs or the like to bias the wings away from the neck.

Figure 9B:
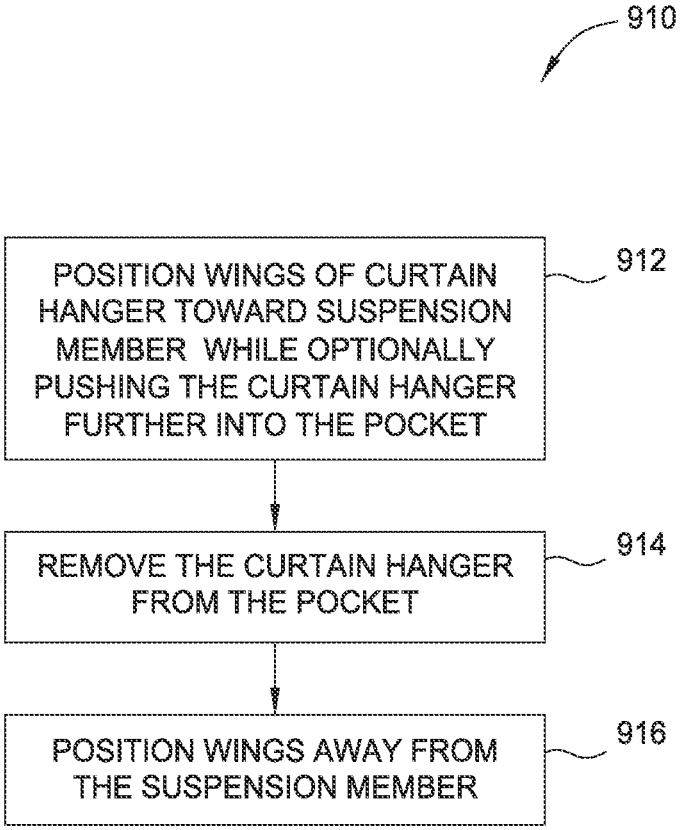
FIG. 9B is a flow chart for a method for removing the curtain hanger of FIG. 1A from a pocket of a curtain.

FIG. 9B illustrates a method 910 for removing a curtain hanger 100 from a curtain (e.g., curtain 500 shown in FIG. 7). In block 912, the wings 120 of the curtain hanger 100 are urged toward the suspension member 101. This could be done, for example, by an operator reaching into a pocket (e.g., pocket 502) of the curtain with her fingers or an appropriate mechanical gripping tool and squeezing the grip portions 130. In some instances, the curtain hanger 100 may be pushed into the pocket as the grip portions 130 are squeezed to enable the teeth 134*a-d* to disengage from the vertical stitches (e.g., vertical stitching 510) and/or the pleats (e.g., pleats 508) that form the pockets. Once the teeth 134*a-d* have disengaged from the stitches and/or pleats, in block 914, the curtain hanger 100 can be removed from the pocket. In block 916, the operator can then release the grip portions 130, enabling the wings 120 to return to a position away from the suspension member 101.

The descriptions of the various aspects of the present invention have been presented for purposes of illustration, but are not intended to be exhaustive or limited to the aspects disclosed. Many modifications and variations will be apparent to those of ordinary skill in the art without departing from the scope and spirit of the described aspects. The terminology used herein was chosen to best explain the principles of the aspects, the practical application or technical improvement over technologies found in the marketplace, or to enable others of ordinary skill in the art to understand the aspects disclosed herein.

While the foregoing is directed to aspects of the present invention, other and further aspects of the invention may be devised without departing from the basic scope thereof, and the scope thereof is determined by the claims that follow.

What is claimed is:

1. A curtain hanger, comprising:

a suspension member comprising a first end and an opposing second end, the first end configured to engage a hanging mechanism, wherein the suspension member includes a neck extending toward the second end and defining a longitudinal axis; and at least two wings at the opposing second end of the suspension member extending away from each other and from the longitudinal axis in different directions, each wing including:

a support that includes a proximal end and a distal end, wherein the support is connected to the neck at the proximal end and includes a tip at the distal end; and a plurality of teeth arranged on the support along a direction of the longitudinal axis, wherein each tooth of the plurality of teeth is arranged on the support at a different distance from the longitudinal axis along the different direction for the particular wing, and wherein each of the plurality of teeth are configured to engage an interior of a pocket of a curtain;

wherein the at least two wings are movable between a first configuration and a second configuration in which a distance between the tips of the at least two wings is less relative to the first configuration to facilitate insertion into and removal from the pocket of the curtain, wherein the at least two wings are biased to return to the first configuration from the second configuration to engage the interior of the pocket after insertion into the curtain, and wherein at least one of the plurality of teeth are arranged to point at least partially in a direction away from the longitudinal axis and at least partially toward the first end of the suspension member when the wings are in the first configuration.

2. The curtain hanger of claim 1, wherein the plurality of teeth comprises four teeth, wherein a first tooth of the four teeth extends from the support at a first angle relative to the longitudinal axis, wherein a second tooth of the four teeth extends from the support at a second angle relative to the longitudinal axis, wherein a third tooth of the four teeth extends from the support at a third angle relative to the longitudinal axis, wherein a fourth tooth of the four teeth extends from the support at a fourth angle relative to the longitudinal axis, and wherein the first angle, the second angle, the third angle, and the fourth angle are different from one another.

3. The curtain hanger of claim 1, wherein each wing further comprises a first support member extending from the neck to the support and a second support member extending from the neck to the support.

4. The curtain hanger of claim 3, wherein the first support member and the second support member define an aperture therebetween.

5. The curtain hanger of claim 3, wherein the first support member and the second support member are resiliently deformable.

6. The curtain hanger of claim 3, wherein the first support member and the second support member comprises a nylon polymer.

7. A curtain assembly, comprising:

a curtain that includes a plurality of pockets;

a plurality of curtain hangers, wherein the plurality of curtain hangers are arranged in respective ones of the plurality of pockets, each of the curtain hangers including:

a suspension member comprising a first end and an opposing second end, the first end configured to engage a hanging mechanism, wherein the suspension member includes a neck extending toward the second end and defining a longitudinal axis;

at least two wings at the opposing second end of the suspension member extending away from each other and from the longitudinal axis in different directions, each wing including:

a support that includes a proximal end and a distal end and a distal end, wherein the support is connected to the neck at the proximal end and includes a tip at the distal end; and a plurality of teeth arranged on the support along a direction of the longitudinal axis, wherein each tooth of the plurality of teeth is arranged on the support at a different distance from the longitudinal axis along the different direction for the particular wing, and wherein each of the plurality of teeth are configured to engage an interior of a pocket of a curtain;

wherein the at least two wings are movable between a first configuration and a second configuration in which a distance between tips of the at least two wings is less relative to the first configuration to facilitate insertion into and removal from the pocket of the curtain wherein the at least two wings are biased to return to the first configuration from the second configuration to engage the interior of the respective one of the plurality of pockets after insertion into the pocket, and wherein at least one of the plurality of teeth are arranged to point at least partially in a direction away from the longitudinal axis and at least partially toward the first end of the suspension member when the wings are in the first configuration.

8. The curtain assembly of claim 7, wherein the plurality of teeth comprises four teeth, wherein a first tooth of the four teeth extends from the support at a first angle relative to a longitudinal axis, wherein a second tooth of the four teeth extends from the support at a second angle relative to the longitudinal axis, wherein a third tooth of the four teeth extends from the support at a third angle relative to the longitudinal axis, wherein a fourth tooth of the four teeth extends from the support at a fourth angle relative to the longitudinal axis, and wherein the first angle, the second angle, the third angle, and the fourth angle are different from one another.

9. The curtain assembly of claim 7, wherein each wing further comprises a first support member extending from the neck to the support and a second support member extending from the neck to the support.

10. The curtain assembly of claim 9, wherein the first support member and the second support member define an aperture there between.

11. The curtain assembly of claim 9, wherein the first support member and the second support member are resiliently deformable.

12. The curtain assembly of claim 9, wherein the first support member and the second support member comprises a nylon polymer.

13. A method of installing a curtain hanger in a pocket of a curtain, wherein the curtain hanger comprises a suspension member comprising a first end and an opposing second end, the first end configured to engage a hanging mechanism on a bulkhead, wherein the suspension member includes a neck extending toward the second end and defining a longitudinal axis, and at least two wings at the opposing second end of the suspension member extending away from each other and from the longitudinal axis in different directions, wherein each of the at least two wings include a support that includes a proximal end and a distal end, wherein the support is connected to the neck at the proximal end and includes a tip at the distal end, and wherein the at least two wings also include a plurality of teeth arranged on the support along a direction of the longitudinal axis, wherein each tooth of the plurality of teeth of each wing is arranged on the support at a different distance from the longitudinal axis along the different direction for the particular wing, wherein the wings are positionable toward the suspension member for insertion into the pocket of the curtain, and wherein the wings are positionable away from the suspension member after insertion into the curtain to engage the interior of the pocket, wherein the at least two wings are movable between a first configuration and a second configuration in which a distance between the tips of the at least two wings is less relative to the first configuration to facilitate insertion into and removal from the pocket of the curtain, wherein the at least two wings are biased to return to the first configuration from the second configuration to engage the interior of the pocket after insertion into the curtain, and wherein at least one of the plurality of teeth are arranged to point at least partially in a direction away from the longitudinal axis and at least partially toward the first end of the suspension member when the wings are in the first configuration, the method comprising:

moving the wings to the second configuration;

inserting the curtain hanger into an opening of the pocket; and moving the wings to the first configuration such that at least one of the plurality of teeth of the wings engage at least one of stitching and pleats arranged at sides of the pocket.

14. The method of claim 13, wherein positioning the wings toward the suspension member comprises applying a force to the wings toward the suspension member, and wherein positioning the wings away from the suspension member comprises removing the force.

15. The method of claim 13, further comprising engaging the suspension member with the hanging mechanism.

16. The method of claim 13, further comprising:

positioning the wings toward the suspension member while simultaneously pushing the curtain hanger further into the pocket such that the teeth of the wings disengage from at least one of stitching and pleats arranged at sides of the pocket; and removing the curtain hanger from the pocket; and positioning the wings away from the suspension member.

* * * * *